US006897717B1

(12) United States Patent
Eddleman et al.

(10) Patent No.: US 6,897,717 B1
(45) Date of Patent: May 24, 2005

(54) METHODS AND CIRCUITS FOR MORE ACCURATELY MIRRORING CURRENT OVER A WIDE RANGE OF INPUT CURRENT

(75) Inventors: Daniel Eddleman, Sunnyvale, CA (US); Christopher Umminger, Mountain View, CA (US)

(73) Assignee: Linear Technology Corporation, Milpitas, CA (US)

( * ) Notice: Subject to any disclaimer, the term of this patent is extended or adjusted under 35 U.S.C. 154(b) by 0 days.

(21) Appl. No.: 10/761,502

(22) Filed: Jan. 20, 2004

(51) Int. Cl.[7] ..... G05F 1/10
(52) U.S. Cl. ..... 327/543; 327/108; 327/404
(58) Field of Search ..... 327/103, 108, 327/109, 110, 111, 112, 403, 404, 538, 543; 323/315, 316

(56) References Cited

U.S. PATENT DOCUMENTS 6,784,651 B2 * 8/2004 Mouret et al. ..... 323/315

OTHER PUBLICATIONS

Galinski, Martin; "Circuit manages power–up sequencing"; EDN; Oct. 31, 2002.
Linear Technology; "LT1645 Dual–Channel Hot Swap Controller/Power Sequencer"; Datasheet; 1999.
Linear Technology; "LTC2920–1/LTC2920–2 Single/Dual Power Supply Margining Controller"; Datasheet, Initial Release; Mar. 2003.
Linear Technology; "LTC3205 Multidisplay LED Controller"; Datasheet, Initial Release; Aug. 2003.
Maxim Integrated Products; "MAX5039/MAX5040 Voltage–Tracking Controllers for PowerPC, DSPs, and ASICs"; Datasheet; May 2002.
Summit Microelectronics, Inc.; "SMT4004 Quad Trakking™ Power Supply Manager", Datasheet; Jun. 9, 2003.
Summit Microelectronics, Inc.; "SMT4004 Quad Tracking Power Supply Manager Advanced Current Sensing Schemes and Power MOSFET Selection"; Application Note 20; Feb. 21, 2002.
Summit Microelectronics, Inc.; "SMT4004 Quad Tracking Power Supply Manager Windows GUI Users Guide and Configuration Register Descriptions"; Application Note 22; Aug. 23, 2002.
Summit Microelectronics, Inc.; "SMT4004–Advanced Voltage Tracking Methods Boost Efficiency, Reliability"; Application Note 26, Advance Information; Oct. 16, 2002.
Summit Microelectronics, Inc.; "Xilinx Virtex™–E, Spartan™–IIE FPGA and SMT4004 TRAKKER™ Supply Manager Reference Design: Procedure and Results Summary"; Application Note 31; Jan. 7, 2003.
Summit Microelectronics, Inc.; "Lossless Tracking Procedure and Results Summary Reference Design: Xilinx Virtex™–E, Spartan™–IIE FPGA and SMT4004 TRAKKER™"; Application Note 34; Jan. 7, 2003.

* cited by examiner

*Primary Examiner*—Jeffrey Zweizig
(74) *Attorney, Agent, or Firm*—Fish & Neave IP Group; Mark D. Rowland; Chi-Hsin Chang

(57) ABSTRACT

The present invention comprises methods and circuits for mirroring input current in multiple stages to improve the accuracy of the mirrored output current over a wide dynamic range of input current. The current mirror circuit of the present invention automatically (1) detects an increasing magnitude of input current and (2) adapts the current mirror circuit to accommodate the increasing magnitude.

26 Claims, 7 Drawing Sheets

METHODS AND CIRCUITS FOR MORE ACCURATELY MIRRORING CURRENT OVER A WIDE RANGE OF INPUT CURRENT

FIELD OF THE INVENTION

The present invention relates to current mirror circuits. More particularly, the present invention relates to methods and circuits for adaptively mirroring input current in multiple stages to improve the accuracy of the output current over a wide range of input current.

BACKGROUND OF THE INVENTION

Current mirrors commonly are used in electronic circuits. The input to a current mirror is a current and the output ideally is a current of identical magnitude or of a magnitude that is a predefined ratio of the input current. As used herein, an output current that is proportional to an input current includes the condition in which the output current is designed approximately to be equal to the input current and the condition in which the output current is designed to be a predefined ratio of the input current.

A basic current mirror designed in a complimentary metal-oxide semiconductor (CMOS) process is shown in FIG. 1. Current mirror 10 comprises a supply voltage $V_{CC}$ coupled to diode-connected input transistor 12 and output transistor 14, wherein the gates of transistors 12 and 14 are connected and the characteristics (e.g., threshold voltage) of the transistors ideally are identical. Responsive to input current $I_{IN}$ flowing through input transistor 12, current mirror 10 generates output current $I_{OUT}$ that ideally is equal to the magnitude of input current $I_{IN}$ or a predefined ratio of the input current.

A common challenge in the design of a current mirror is to obtain an output current that is as close as possible to the input current or to the predefined ratio of the input current. Mismatch of threshold voltages ($V_T$) and transconductances ($\beta$) of transistors 12 and 14 may result in output current $I_{OUT}$ that is not identical to the input current or to the predefined ratio of the input current. At low input current levels, where the $|V_{GS}|-V_T$ overdrive voltage is small, the threshold voltage mismatch typically dominates and leads to inaccuracies. At higher input currents, when the $|V_{GS}|-V_T$ overdrive is greater, the threshold mismatch is less significant and the transconductance mismatch ($\Delta\beta/\beta$) usually dominates. The transconductance of, e.g., an enhancement-type MOSFET is $\beta=\mu C_{OX}*W/L$, where $\mu$ is the mobility of the electrons in the induced channel, $C_{OX}$ is the capacitance per unit area of the gate-to channel capacitor, L is the length of the channel, and W is the width of the channel.

To reduce the threshold voltage mismatch and thereby improve the accuracy of the current mirror, degeneration resistors R1 and R2 may be coupled between supply voltage $V_{CC}$ and the sources of transistors 12 and 14 (respectively), as illustrated in FIG. 2. If the mismatch between resistors is less than the mismatch between the transistors and a voltage comparable to the nominal threshold voltage of transistors 12,14 appears across them, the overall accuracy of the mirror is improved. Alternatively, in a CMOS process, the matching between the transistors can be improved by increasing their lengths (L). This increases the $|V_{GS}|-V_T$ overdrive and reduces the effects of threshold voltage mismatch. As used herein, the term "nominal threshold voltage" refers to the ideal threshold voltage for which a given transistor is designed. While two transistors may be designed to have the same nominal threshold voltage, manufacturing limitations may cause mismatch of the threshold voltages, thereby potentially causing the current mirror to generate an output current that inaccurately mirrors the input current.

While adding resistive degeneration or increasing the lengths of CMOS devices improves current mirror accuracy, both methods reduce the current mirror's dynamic range. If a resistor value or transistor length is chosen to improve the accuracy for low input current magnitudes, a larger input current magnitude results in a larger voltage drop across the resistor or transistor. When this voltage drop becomes comparable to total supply voltage $V_{CC}$, the current mirror ceases to be useful. Ultimately, this limits the range of currents that can be mirrored accurately.

In view of the foregoing, it would be desirable to be able to provide methods and circuits for mirroring input current that improves the accuracy of the output current over a wide range of input current.

It further would be desirable to be able to provide methods and circuits for mirroring a wide range of input current, wherein the current mirror circuit automatically (1) detects an increasing magnitude of input current and (2) adapts the current mirror to accommodate the increasing magnitude.

SUMMARY OF THE INVENTION

In view of the foregoing, it is an object of the present invention to provide methods and circuits for mirroring input current that improves the accuracy of the output current over a wide range of input current.

It further is an object of the present invention to provide methods and circuits for mirroring a wide range of input current, wherein the current mirror circuit automatically (1) detects an increasing magnitude of input current and (2) adapts the current mirror to accommodate the increasing magnitude.

These and other objects of the present invention are accomplished by a current mirror circuit that incorporates at least first and second individual current mirrors, wherein the first current mirror has a first current range and the second current mirror has a second current range. In one embodiment, the second current range spans magnitudes of current that are greater than those of the first current range. When the magnitude of the input current falls within the first current range, only the first current mirror is activated to mirror the input current. An initiation circuit automatically detects when the magnitude of the input current equals or exceeds a maximum current level, and automatically activates the second current mirror in response. The input current then is distributed between the two current mirrors. The mirrored output currents of each individual current mirror are added together to form the output current of the current mirror circuit of the present invention.

Additional current mirrors may be coupled to the first and second current mirrors to accommodate input current levels that exceed the capacity of the first and second current ranges.

The current mirror circuit of the present invention may be used in various applications, is including, but not limited to, a tracking/sequencing circuit for ramping the output of a slave power supply in a defined relationship to a master signal, e.g., a signal generated by a master power supply.

BRIEF DESCRIPTION OF THE DRAWINGS

Further features of the present invention, its nature and various advantages will be more apparent from the accompanying drawings and the following detailed description, in which.

DETAILED DESCRIPTION OF THE INVENTION

Figure 1:
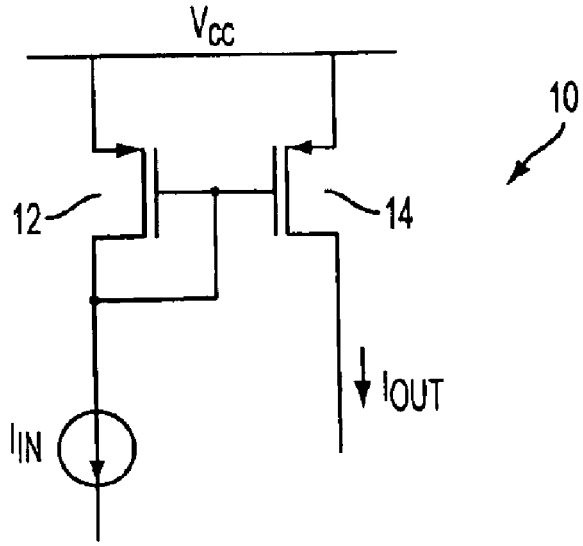
FIG. 1 is a schematic of an illustrative basic current mirror.
Figure 3B:
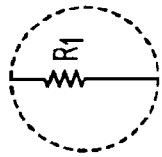
FIG. 3B shows a resistor that may be incorporated into the current mirror circuit of FIG. 3A.
Figure 3A:
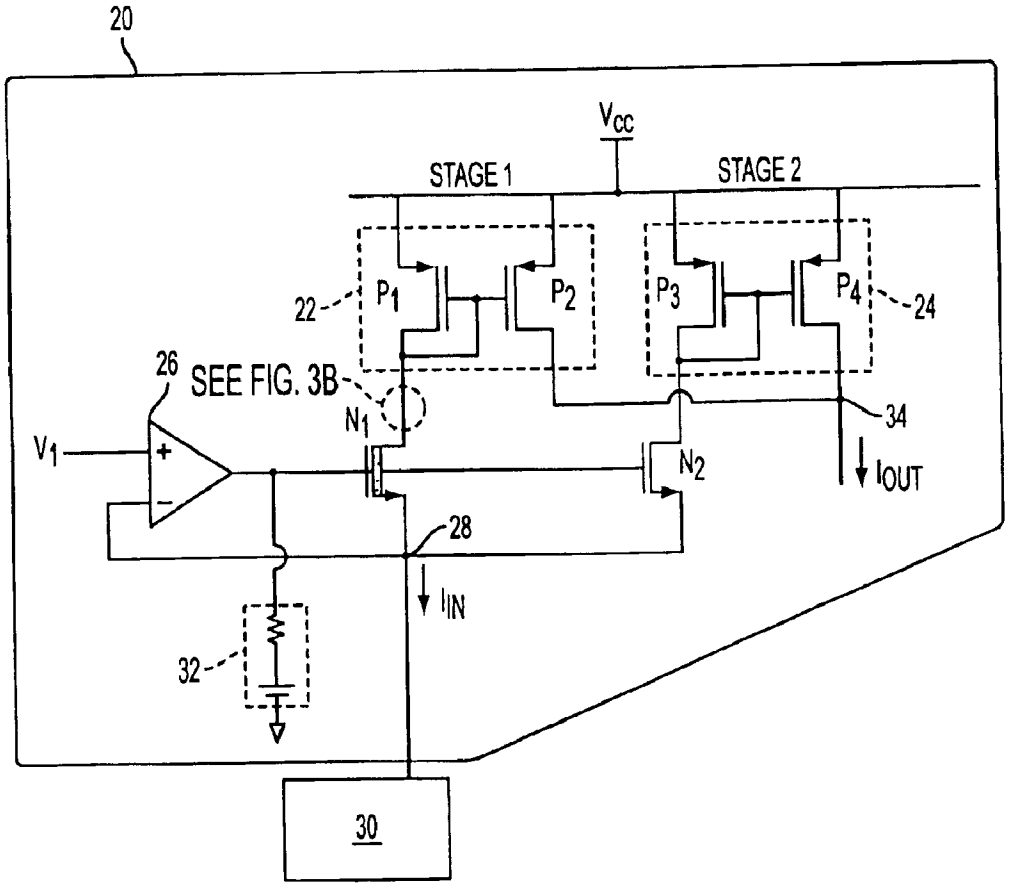
FIG. 3A is a schematic of a first embodiment of the current mirror circuit of the present invention.

Referring to FIG. 3A, an illustrative current mirror circuit of the present invention is described. Current mirror circuit 20 comprises two basic current mirrors 22 and 24, each similar to that described with respect to FIG. 1.

Current mirror 22 uses two PMOS transistors diode-connected input transistor P1 and output transistor P2—having the same nominal threshold voltage $V_{T1}$. The gates of input and output transistors P1 and P2 are tied together and the sources of the transistor are coupled to supply voltage $V_{CC}$. Because the $V_{SG}$ voltages of transistors P1 and P2 are the same and both transistors are driven by a common supply voltage $V_{CC}$, the output current at the drain of transistor P2 is proportional to the input current at the drain of transistor P1, ignoring transistor mismatch described above. If the width to length ratios (W/L) of transistors P1 and P2 are the same, then the output current at the drain of transistor P2 approximately is equal to the input current at the drain of transistor P1, ignoring transistor mismatch. If the width to length ratio of output transistor P2 is greater than that of input transistor P1, the output current of current mirror 22 also will be proportionally greater than its input current. In the following discussion, unless it is otherwise stated, it is assumed that transistors comprising a current mirror pair, such as transistors P1 and P2, have the same W/L ratio and thus the current mirror formed by the transistors, such as current mirror 22, generates an output current that approximately is equal to its input current. However, the W/L ratios of the transistors of any of the current mirror pairs discussed herein, such as transistors P1 and P2, can be different from each other without departing from the scope of the invention. As used herein and stated above, an output current that is proportional to an input current includes the 1:1 relationship in which the output current is designed approximately to be equal to the input current.

Similarly, current mirror 24 uses two PMOS transistors—diode-connected input transistor P3 and output transistor P4—having the same nominal threshold voltage $V_{T2}$. Threshold voltage $V_{T2}$ may be the same voltage as or a different voltage than threshold voltage $V_{T1}$ of current mirror 22. The gates of input and output transistors P3 and P4 are tied together and the sources of the transistors are coupled to supply voltage $V_{CC}$. Because the $V_{SG}$ voltages of transistors P3 and P4 are the same and both transistors are driven by a common supply voltage $V_{CC}$, the output current at the drain of transistor P4 is a predefined ratio of the input current at the drain of transistor P3 based on the width to length ratios of the two transistors, ignoring transistor mismatch described above and assuming infinite output impedance. In the following discussion, it is assumed that transistors P3 and P4 have the same W/L ratio and thus current mirror 24 generates an output current that approximately is equal to its input current. However, the W/L ratios of transistors P3 and P4 can be different without departing from the scope of the invention.

Figure 2:
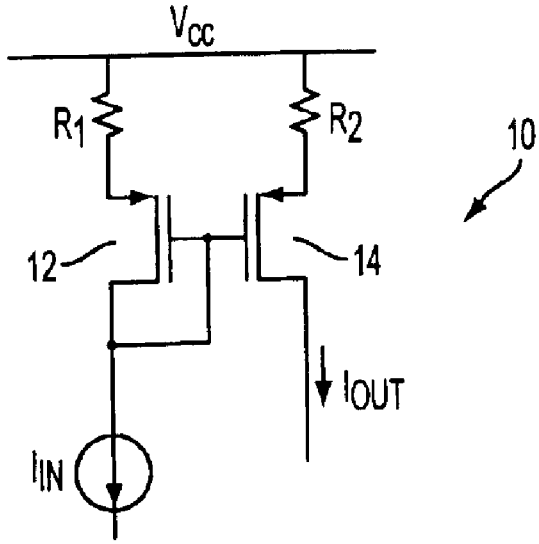
FIG. 2 is a schematic of an illustrative basic current mirror designed to mirror input current within a predetermined current range using degeneration resistors.

The current range typically is determined by the amount of headroom available to drive the current mirror and the requirement that the output transistor remain in saturation for proper operation. The headroom limits the maximum $|V_{GS}|-V_T$ overdrive that can be applied to the input transistor of the current mirror. In the embodiment of FIG. 3A, current mirror 22 of mirroring Stage 1 is designed to mirror input currents with magnitudes (e.g., 1–10 $\mu$A) that are lower than the magnitudes for which current mirror 24 of mirroring Stage 2 is designed (e.g., 10–100 $\mu$A). This can be accomplished by increasing length L (or decreasing the width to length ratio) of transistors P1 and P2 with respect to that of P3 and P4, consequently decreasing the overdrive voltage of current mirror 22 with respect to that of current mirror 24. Alternatively, if degeneration resistors are used to improve the accuracy of the current mirror in a manner similar to that described with respect to FIG. 2, current mirror 22 may be designed to mirror smaller input currents than current mirror 24 by using degeneration resistors having greater resistance than any degeneration resistors coupled to current mirror 24. Either or both techniques may be used together in an individual stage or other techniques also may be used.

Current mirror circuit 20 also comprises integral high-gain op amp 26 having a feedback loop that servos its inverting input 28 at reference voltage $V_1$, the voltage at the non-inverting input of op amp 26. Current mirror circuit 20 operates to provide as much input current $I_{IN}$ as needed to maintain node 28 at voltage $V_1$. If input circuit 30 forces the voltage at node 28 to be greater than $V_1$, current mirror circuit 20 shuts down since transistors N1 and N2 cannot sink current which is necessary to pull node 28 down to voltage $V_1$. The output of op amp 26 is connected to the gate of NMOS transistor N1, which has a source connected to node 28 and a drain connected to the drain of transistor P1 of current mirror 22. The output of op amp 26 also is connected to the gate of NMOS transistor N2, which may, but not necessarily, have a width to length ratio (W/L) less than that of transistor N1 but large enough to support the expected input current $I_{IN}$. Alternatively, the W/L ratio of transistor N2 may be equal to or larger than that of transistor N1. Transistor N2 also has a source connected to node 28 and a drain connected to the drain of transistor P3 of current mirror 24. In the embodiment of FIG. 3A, the threshold voltage of transistor N2 is set to be greater than that of transistor N1 and equal to the $V_{GS}$ voltage of transistor N1 when input current $I_{IN}$ equals the maximum range magnitude for which current mirror 22 is designed. Although the following discussion assumes that Stage 2 activates when input current $I_{IN}$ equals the maximum range magnitude for which Stage 1 is designed, as with any of the current mirror circuits described herein, Stage 2 may be activated when input current $I_{IN}$ equals or exceeds a maximum current level that is less than or greater than the maximum range magnitude for which Stage 1 is designed. When op amp 26 provides an output signal, that signal is compensated by compensation circuit 32, which may include, but is not limited to, a resistor and capacitor connected in series to ground.

In operation, op amp 26 servos node 28 at reference voltage $V_1$ and outputs a voltage signal to the gates of transistors N1 and N2. When input current $I_{IN}$ is less than the maximum range magnitude for which current mirror 22 is designed, the voltage signal output by op amp 26 is less than the threshold voltage of transistor N2. Accordingly, Stage 2 of current mirror circuit 20 is off and all input current $I_{IN}$ is mirrored by Stage 1 current mirror 22.

Transistor N1 buffers input current $I_{IN}$ from its source, node 28, to its drain, establishing a voltage drop from its drain to its source. Since the drain of transistor N1 is connected to transistor P1, the current through transistor N1, and thus transistor P1, establishes a voltage at the gates of transistors P1 and P2 that turns on transistors P1 and P2 to conduct current therethrough. Transistor P2 mirrors the current flowing through transistor P1, and outputs that current through output node 34.

With increasing input current $I_{IN}$, the magnitude of the $V_{SG}$ voltage of transistor P1 increases. Since the voltage at the source of transistor P1 is fixed at supply voltage $V_{CC}$, this drives the voltage at the gate of transistor P1 down towards the voltage at the source of transistor N1. As $I_{IN}$ increases, the $V_{GS}$ voltage of N1 increases. Since op amp 26 has a high gain, the op amp is able to continue servoing node 28 at reference voltage $V_1$ so long as input circuit 30 does not force the voltage at node 28 to be greater than reference voltage $V_1$.

As input current $I_{IN}$ increases further, causing an equal increase in the current conducted through transistors P1 and N1, transistor P1 may drive transistor N1 from the saturation region of operation into the linear region, where the $V_{GS}$ voltage of transistor N1 increases at a faster rate for a given increase in input current $I_{IN}$ than when the transistor is operated in saturation. Alternatively, if current mirror 20 is designed so that transistor P1 does not drive transistor N1 from the saturation region of operation into the linear region, the $V_{GS}$ voltage of transistor N1 also increases responsive to increasing input current $I_{IN}$.

Current mirror circuit 20 automatically detects when input current $I_{IN}$ equals or exceeds the maximum range magnitude for which current mirror 22 is designed and turns on Stage 2 responsive thereto. When the $V_{GS}$ voltage of transistor N1 equals or exceeds the threshold voltage of transistor N2, transistor N2 turns on and supplies a portion of input current $I_{IN}$. The amount of input current supplied by Stage 2 (or current mirror 24) is the difference between the total input current to be supplied at node 28 and the maximum range magnitude for which Stage 1 is designed to mirror. Transistor P4 mirrors the portion of input current $I_{IN}$ supplied by Stage 2, and thus flowing through transistors P3 and N2, and outputs that current through output node 34 where it adds to the fraction of output current $I_{OUT}$ sourced from current mirror 22 of Stage 2.

When the portion of input current $I_{IN}$ supplied by Stage 2 is small, the output current of Stage 2 may be inaccurate since current mirror 24 is designed for larger current magnitudes. However, current mirror 22 of Stage 1 continues to produce an accurate output current. Accordingly, when the current produced by both Stages 1 and 2 are added together to form output current $I_{OUT}$ of current mirror circuit 20, output current $I_{OUT}$ is more accurate than the output current that would have been produced had input current $I_{IN}$ been mirrored only by current mirror 24. As input current $I_{IN}$ increases further, more current is mirrored by current mirror 24. Since current mirror 24 is designed for larger currents, its accuracy will improve as its output current becomes a larger fraction of the total output current $I_{OUT}$.

Current mirror circuit 20 automatically detects when input current $I_{IN}$ decreases to a magnitude less than that of the maximum range magnitude for which current mirror 22 is designed and automatically turns off Stage 2 responsive thereto. When the $V_{GS}$ voltage of transistor N1 decreases to a value less than that of the threshold voltage of N2, Stage 2 and current mirror 24 shuts off.

To adjust the amount of input current $I_{IN}$ needed to turn Stage 2 on, the threshold voltage of transistor N2 may be adjusted. If the threshold voltage of transistor N2 is reduced to a value that remains larger than the threshold voltage of transistor N1, Stage 2 will turn on before input current $I_{IN}$ rises to the maximum range magnitude for which current mirror 22 is designed. In contrast, if the threshold voltage of transistor N2 is increased, Stage 2 will turn on after input current $I_{IN}$ rises to the maximum range magnitude for which current mirror 22 is designed.

The amount of input current needed to turn Stage 2 on also may be adjusted by adjusting the width to length ratio (W/L) of transistor N1. For example, for smaller width to length ratios, the $V_{GS}$ voltage of transistor N1 increases at a faster rate to support a given increase in input current $I_{IN}$ than a transistor with a larger width to length ratio. Since the $V_{GS}$ voltage of transistor N1 increases at a faster rate and thereby reaches the threshold voltage of transistor N2 faster, transistor N2 turns on faster. The result is that less input current $I_{IN}$ is mirrored by Stage 1 of current mirror circuit 20 for a given input current $I_{IN}$ before Stage 2 turns on.

The amount of input current needed to turn Stage 2 on also may be reduced by incorporating resistor R1 between the drains of transistors P1 and N1, as shown in FIG. 3B. Typically, supply voltage $V_{CC}$ is set by the application in which current mirror circuit 20 is used. The larger the supply voltage $V_{CC}$, the more input current that is needed to reduce the voltage at the drain of transistor P1 and thereby drive the voltage at the drain of transistor N1 closer to its source voltage as described above. By inclusion of resistor R1, an additional voltage drop is established across the resistor to drive the drain voltage of transistor N1 lower than the drain voltage of transistor P1. Accordingly, for a given input current, the $V_{GS}$ voltage of transistor N1 is higher with the inclusion of resistor R1 than it is without.

Figure 4:
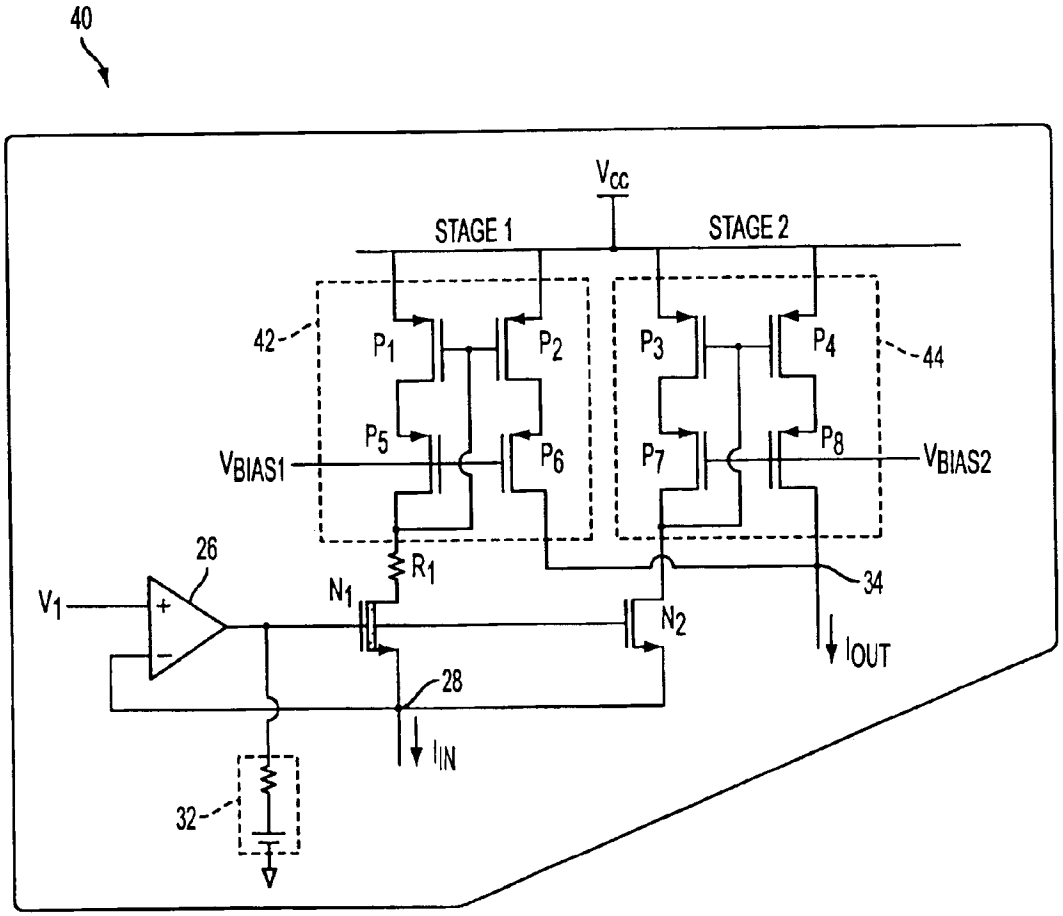
FIG. 4 is a schematic of a second embodiment of the current mirror circuit of the present invention.

Referring now to FIG. 4, an alternative embodiment of current mirror circuit 20 of FIGS. 3A–B is described. Current mirror circuit 40 of the present invention replaces basic current mirrors 22 and 24 with cascode current mirrors 42 and 44 (respectively). In addition to PMOS transistors P1 and P2, cascode current mirror 42 further comprises cascode PMOS transistors P5 and P6, wherein the sources of transistors P5 and P6 are connected to the drains of transistors P1 and P2, the drain of transistor P5 is connected to resistor R1 and the gates of transistors P1 and P2, and the drain of transistor P6 is connected to output node 34. Likewise, cascode current mirror 44 also comprises additional cascode PMOS transistors P7 and P8, wherein the sources of transistors P7 and P8 are connected to the drains of transistors P3 and P4, the drain of transistor P7 is connected to the drain of transistor N2 and the gates of transistors P3 and P4, and the drain of transistor P8 is connected to output node 34.

Inclusion of the cascode transistors reduces errors at high supply voltages. Without the cascodes, the drain of transistor P1 is biased a $V_{GS}$ voltage below supply voltage $V_{CC}$ while the drain of transistor P2 is biased at a fixed voltage above ground. The cascodes eliminate this voltage difference at the drains of transistors P1 and P2 and the consequent mismatch in the current mirror due to the finite output impedance of transistors P1 and P2. Resistor R1 limits the current in Stage 1 so that the voltage at the gates of transistors P1 and P2 does not decrease to a level that allows transistors P5 and P6 to drive them into the linear region.

The gates of transistors P5 and P6 and transistors P7 and P8 respectively are biased by voltages $V_{BIAS1}$ and $V_{BIA2}$, which are designed to establish a constant voltage drop across output mirror transistors P2 and P4 (respectively). These bias voltages respectively isolate transistors P2 and P4 from load-induced voltage changes at output node 34 so that the ratio of output current $I_{OUT}$ to input current $I_{IN}$ relatively is constant. The bias voltages are chosen to bias the cascode transistors so that transistors P1–P4 remain in saturation. For example, bias voltage $V_{BIAS1}$ may be designed to prevent the voltage at the drain of transistors P1 and P2 from increasing beyond the voltage at the gate of transistors P1 and P2 by more than the nominal threshold voltages of transistors P1 and P2. Likewise, bias voltage $V_{BIAS2}$ may be designed to prevent the voltage at the drain of transistors P3 and P4 from increasing beyond the voltage at the gate of transistors P3 and P4 by more than the nominal threshold voltages of transistors P3 and P4. Alternative configurations of cascode current mirrors may be used, in addition to other types of current mirrors, e.g., Wilson configuration mirrors and modified Wilson configuration mirrors.

Numerous applications have requirements concerning the relative behavior between multiple power supplies. The applications may require that the supplies ramp up and ramp down together in defined relationships, e.g., coincident tracking at a specific common rate (see FIG. 5A), with fixed voltage offsets (see FIG. 5B), ratiometrically (see FIG. 5C), or in a particular sequence (see FIG. 5D). FIG. 6 illustrates that either current mirror circuit 20 or 40 of FIGS. 3 and 4 (respectively) may be incorporated in a tracking and sequencing circuit for ramping a slave power supply in such defined relationships to a master signal. Tracking/sequencing circuit 50 controls ramp up and ramp down of slave supply 52 responsive to master signal $V_{MASTER}$, which may be generated, e.g., from a master power supply (not shown) and used to power an electronic device. Slave supply 52 may be any power supply that may be modeled as amplifier 54 with a reference voltage $V_2$ and a feedback network having two feedback resistors 56 and 58 connected to feedback node 60 of amplifier 54. Tracking/sequencing circuit 50 generates a current responsive to master signal $V_{MASTER}$ and injects that current into feedback node 60 of slave supply 52 to control the output voltage $V_{SLAVE}$ of the slave supply.

Tracking/sequencing circuit 50 comprises voltage divider 62, having resistors 63 and 65, that divides master signal $V_{MASTER}$ and establishes divided master signal $V_{DIV}$ at node 64. Node 64 is interposed between resistors 63 and 65 and is connected to input node 28 of current mirror circuit 20,40 of the present invention. Output node 34 of current mirror circuit 20,40 is connected to feedback node 60 of slave supply 52. For given values of feedback resistors 56 and 58 of slave supply 52, the values of resistors 63 and 65 establish the ramping relationship between output voltage $V_{SLAVE}$ of power supply 52 and master signal $V_{MASTER}$.

As discussed hereinabove with respect to FIG. 3A, current mirror circuit 20,40 incorporates high gain op amp 26 that servos node 28, and thus node 64 of voltage divider 62 tied thereto, at reference voltage $V_1$. If divided master signal $V_{DIV}$ is less than reference voltage $V_1$, current mirror circuit 20,40 sources as much input current $I_{IN}$ as necessary to raise the voltage at node 28,64 to reference voltage $V_1$.

The following detailed discussion of tracking/sequencing circuit 50 focuses on control of slave supply 52 to coincidentally track master signal $V_{MASTER}$. The remaining defined relationships illustrated in FIGS. 5B–D is discussed in greater detail in co-pending U.S. patent application Ser. No. 10/761,501 to Eddleman, filed on Jan. 20, 2004, entitled "METHODS AND CIRCUITS FOR TRACKING AND SEQUENCING MULTIPLE POWER SUPPLIES", which hereby is incorporated in its entirety. For illustrative purposes only, it is assumed that reference voltage $V_1$ is selected to be equal to reference voltage $V_2$ and that current mirror circuit 20,40 is designed so that the input current/output current ratio ($I_{IN}/I_{OUT}$) is 1:1. However, without departing from the scope of the invention, reference voltage $V_1$ may be selected to be a voltage different than reference voltage $V_2$, and, as discussed hereinabove, current ratio $I_{IN}/I_{OUT}$ of any of the current mirrors discussed herein at various parts may be designed to be other than 1:1.

Figure 5A:
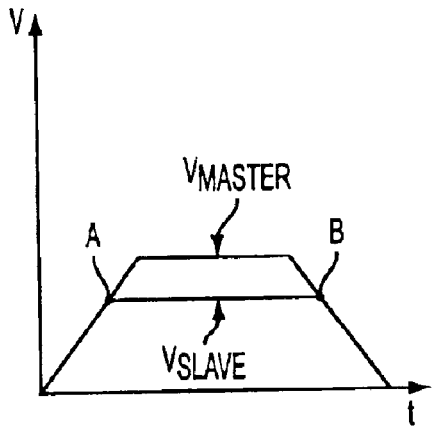
FIG. 5 are graphs of illustrative results of a tracking and sequencing application in which the current mirror circuit of the present invention may be incorporated.
Figure 5B:
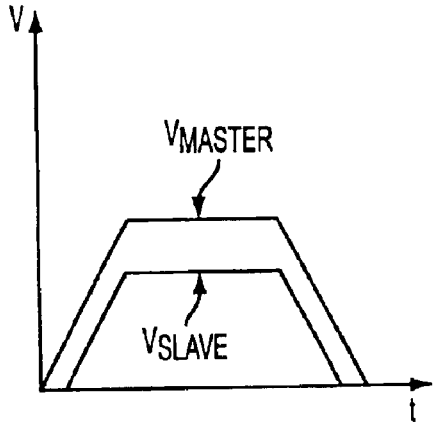
Figure 5C:
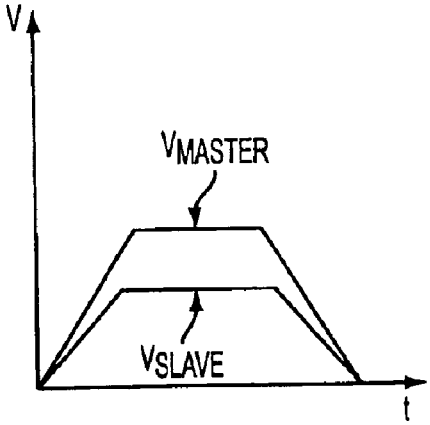
Figure 5D:
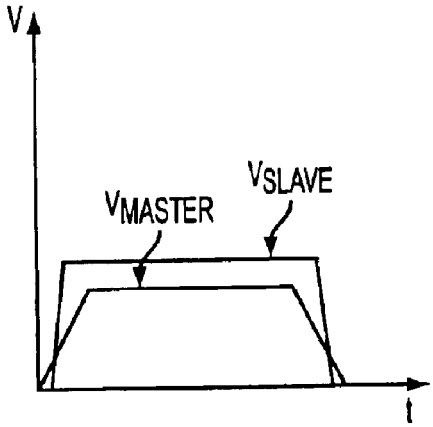
Figure 6:
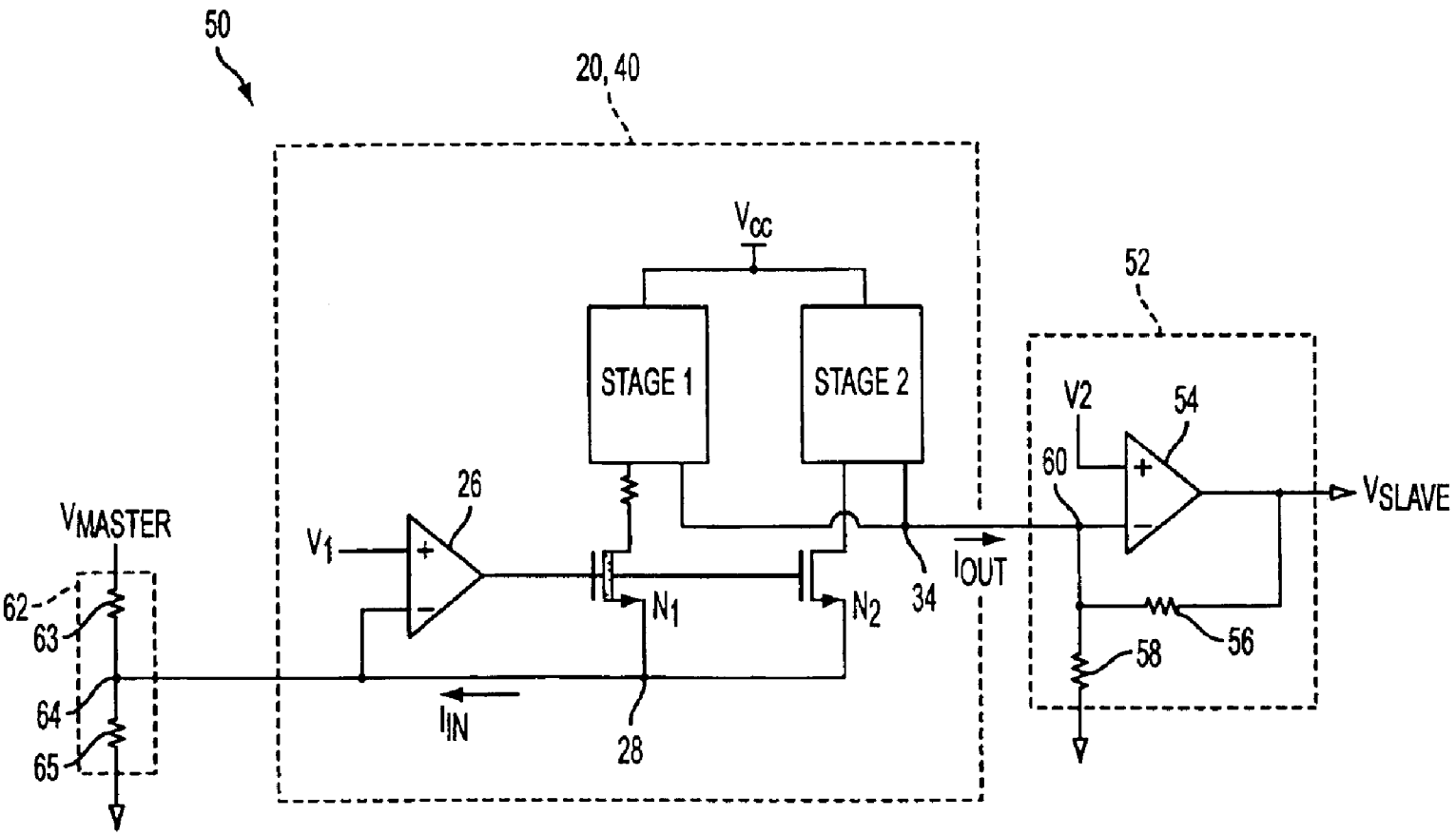
FIG. 6 is a block diagram of the tracking and sequencing application in which the current mirror circuit of the present invention may be incorporated.

To ramp up and ramp down output voltage $V_{SLAVE}$ of slave supply 52 coincident with master signal $V_{MASTER}$, as shown in FIG. 5A, resistors 63 and 65 are selected to be equal in resistance to feedback resistors 56 and 58 (respectively) if reference voltages $V_1$ and $V_2$ are equal. When master signal $V_{MASTER}$ is at 0V, and thus the voltages at node 28,64 also would have been equal to 0V absent op amp 26, current mirror circuit 20,40 provides maximum input current $I_{IN,MAX}$ through node 28,64 to raise the voltage at node 28,64 to reference voltage $V_1$. As discussed with respect to FIG. 3A, when current mirror circuit 20,40 needs to mirror input current $I_{IN}$ having a magnitude equal to or greater than the maximum range magnitude for which Stage 1 is designed, current mirror circuit 20,40 automatically detects this condition and turns on both Stage 1 and Stage 2. In the discussion herein, it is assumed that current mirror circuit 20,40 is designed so that Stage 1 and Stage 2 are turned on when input current $I_{IN}$ is at a maximum. However, current mirror circuit 20,40 may be designed so that only Stage 1 is active when input current $I_{IN}$ is at a maximum. Wide range current mirror circuit 20,40 allows circuit 50 to accommodate widely varying feedback resistors 56 and 58 in various applications.

Activating both Stage 1 and Stage 2, current mirror 20,40 mirrors maximum input current $I_{IN,MAX}$ and generates maximum output current $I_{OUT,MAX}$ that is equal in magnitude to maximum current $I_{IN,MAX}$ at output node 34 and feedback node 60 of slave supply 52. Since the voltage at which amplifier 54 servos feedback node 60, and thus output node 34 connected thereto, is equal to reference voltage $V_1$, the input current to output current ratio of current mirror circuit 20,40 is 1:1 and resistances of feedback resistors 56 and 58 are equal to resistors 63 and 65 (respectively), output current $I_{OUT}$ sourced by current mirror circuit 20,40 is distributed through resistors 58 and 56 so that the current flowing across resistor 56 is equal to the current flowing across resistor 63 and the current flowing across resistor 58 is equal to the current flowing across resistor 65. This forces output voltage $V_{SLAVE}$ of slave supply 54 to be equivalent to master signal $V_{MASTER}$.

As master signal VASTER increases, current mirror circuit 20,40 is required to provide less input current $I_{IN}$ to servo node 28,64 at reference voltage $V_1$. An equivalent decrease in output current $I_{OUT}$ is generated by current mirror circuit 20,40. When the amount of input current $I_{IN}$ needed to servo node 28,64 at reference voltage $V_1$ decreases to a level less than the maximum range magnitude for which Stage 1 is designed, current mirror circuit 20,40 automatically detects this condition and turns stage 2 off by turning transistor N2 off.

When master signal VASTER rises to a level that, when divided by voltage divider 62, forces the voltage at node 28,64 at reference voltage $V_1$ (see, e.g., point A on FIG. 5A), current mirror circuit 20,40 does not need to provide any input current $I_{IN}$. Accordingly, no output current $I_{OUT}$ is generated by current mirror source 20,40 and injected into feedback node 60 of slave supply 52. Current mirror circuit 20,40 presents a high impedance at feedback node 60 of the slave supply 52, permitting the slave supply to regulate output voltage $V_{SLAVE}$ without being affected by current mirror circuit 20,40 and master signal $V_{MASTER}$.

As master supply $V_{MASTER}$ continues to increase beyond the voltage at point A in FIG. 5A, input current $I_{IN}$ and output current $I_{OUT}$ remain at zero and slave supply 52 continues to regulate its output voltage $V_{OUT}$ independently of master signal $V_{MASTER}$. During ramp down of master signal $V_{MASTER}$, tracking/sequencing circuit 50 resumes control of output voltage $V_{SLAVE}$ of slave supply 52 responsive to master signal $V_{MASTER}$ once master signal $V_{MASTER}$ has reduced to a value that, when divided by voltage divider 62, would cause the voltage at node 64 to be below reference voltage $V_1$ if node 64 were not connected to node 28 (see, e.g., point B on FIG. 5A).

Figure 7:
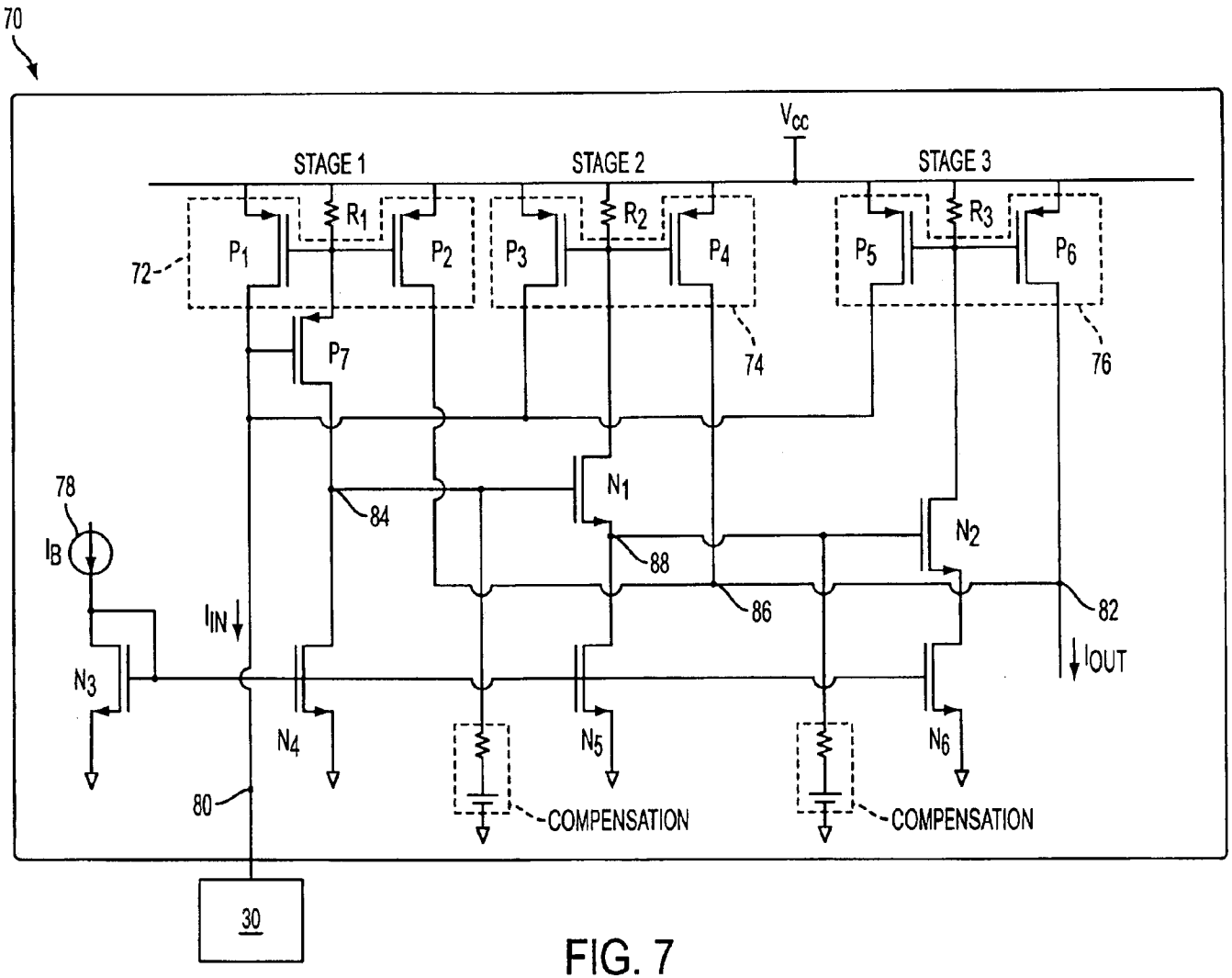
FIG. 7 is a schematic of a third embodiment of the current mirror circuit of the present invention.

Referring now to FIG. 7, a third embodiment of the current mirror circuit of the present invention is described, in which an alternative initiation circuit is employed automatically to (1) detect when a current mirror designed for small currents has reached capacity and (2) activate a second current mirror designed for larger currents responsive to that detection. Current mirror circuit 70 comprises three stages of current mirrors—each successive stage designed to mirror successively larger input currents.

Stage 1 comprises first current mirror 72 having PMOS transistors P1 and P2 connected together so that their sources are tied to common supply voltage $V_{CC}$ and their gates are tied together. Transistors P1 and P2 are designed to have the same nominal threshold voltage and the same width to length (W/L) ratio. Stage 2 includes second current mirror 74 designed to mirror larger magnitudes of input currents than current mirror 72 of Stage 1. Current mirror 74 also comprises two PMOS transistors P3 and P4 disposed with their sources connected to common supply voltage $V_{CC}$ and their gates tied together. Transistors P3 and P4 are designed to have the same nominal threshold voltage and the same width to length ratio. Stage 3 incorporates third current mirror 76 designed to mirror magnitudes of input currents larger than the current magnitudes for which Stage 1 and Stage 2 are designed. Current mirror 76 of Stage 3 incorporates two PMOS transistors P5 and P6 disposed with their sources connected to common supply voltage $V_{CC}$ and their gates tied together. Transistors P5 and P6 are designed to have the same nominal threshold voltage and the same width to length ratio.

Current mirror circuit 70 further comprises a plurality of NMOS transistors coupled to Stages 1–3 to automatically detect when each Stage has reached capacity and activate the next successive Stage responsive thereto. Current source 78 delivers comparison current $I_B$ to transistor N3, which is diode-connected. Since the gate of transistor N3 is tied to the gates of transistors N4–N6 and the sources of transistors N3–N6 are all tied to common ground, transistors N4–N6 mirrors comparison current $I_B$ at each of their drains assuming that the width to length ratios of transistors N3–N6 are equal and the nominal threshold voltages of transistors N3–N6 are equal. Transistors N3–N6 may be designed to mirror currents having magnitudes commensurate with comparison current $I_B$.

In operation, input circuit 30 that is coupled to input node 80 establishes a voltage at input node 80 that is less than supply voltage $V_{CC}$ when input current $I_{IN}$ is zero. This sets up a positive $V_{SG}$ voltage across transistor P7, which has its gate connected to node 80 and its source connected to the gates of transistors P1 and P2 and to supply voltage $V_{CC}$ via resistor R1. Thereafter, transistor P7 turns on and conducts current through resistor R1 and transistor P7. Current flowing through resistor R1 establishes a voltage drop from the source of transistor P1 to its gate, permitting transistor P1 to source input current $I_{IN}$ to input node 80 and input circuit 30. Input current $I_{IN}$ flowing through transistor P1 is mirrored by transistor P2, generating output current $I_{OUT}$ at output node 82.

As current is flowing through resistor R1 and transistor P7, transistor N4 attempts to mirror and sink current having a magnitude equal to comparison current $I_B$ at node 84 interposed between the drains of transistors P7 and N4. When the magnitude of the current conducted through resistor R1 and transistor P7 (i.e., a current having a magnitude of $V_{SG(P1)}$/R1) is less than that of comparison current $I_B$, transistor N4 cannot sink the full comparison current $I_B$ and only sinks the amount of current conducted through resistor R1 and transistor P7. Consequently, this biases the voltage at the drain of N4 (and thus the gate of transistor N1 to which the drain of transistor N4 is connected) lower than the threshold voltage of transistor N1, assuming that the threshold voltage of transistor. N1 equals the voltage at the drains of transistors P7 and N4 when the current flowing through transistor P7 is equal in magnitude to comparison current $I_B$.

With increasing input current $I_{IN}$ demanded by input circuit 30, the $V_{SG}$ voltage of transistor P7 increases, causing more current to be conducted through resistor R1 and transistor P7. This in turn increases the $V_{SG}$ voltage of transistor P1, which permits the greater input current $I_{IN}$ to be conducted through transistor P1 and thereby mirrored by transistor P2. As current conducted through resistor R1 and transistor P7 increases, transistor N4 also is able to sink more current, thus driving the voltage at the drain of transistor N4 higher.

When the current conducted through resistor R1 and transistor P7 exceeds comparison current $I_B$, the voltage at the drain of transistor N4 increases to a large enough value that it exceeds the threshold voltage of transistor N1, turning on transistor N1 to conduct current therethrough. The amount of input current $I_{IN}$ directed to Stage 2 equals the difference between the total input current $I_{IN}$ and the current level flowing through transistor P1 when the current flowing through resistor R1 exceeded comparison current $I_B$. In a preferred embodiment, the current level flowing through transistor P1 when the current flowing through resistor R1 exceeds comparison current $I_B$ is designed to be equal to the maximum range magnitude for which Stage 1 and current mirror 72 is designed. Alternatively, the current level flowing through transistor P1 when the current flowing through resistor R1 exceeded comparison current $I_B$ may be designed to be greater or less than the maximum range magnitude for which Stage 1 and current mirror 72 is designed.

When transistor N1 is turned on, current is capable of being conducted through resistor R2. Current conducted through transistor R2 establishes a voltage drop from the source of transistor P3 to its gate, which is connected to the drain of transistor N1 and to supply voltage $V_{CC}$ via resistor R2. This permits transistor P3 to conduct the portion of input current $I_{IN}$ directed to Stage 2 therethrough. Transistor P4 mirrors the current conducted through transistor P3 and generates an output current that is added to the output current generated by Stage 1 at output node 86,82 to form total output current $I_{OUT}$.

As current is flowing through resistor R2 and transistor N1, transistor N5 attempts to mirror and sink current having a magnitude equal to comparison current $I_B$ at node 88 interposed between the source of transistor N1 and the drain of transistor N5. When the magnitude of the current conducted through resistor R2 and transistor N1 (i.e., a current having a magnitude of $V_{SG(P3)}/R2$) is less than that of comparison current $I_B$, transistor N5 cannot sink the full comparison current $I_B$ and only sinks the amount of current conducted through resistor R2 and transistor N1. Consequently, this biases the voltage at the drain of N5 (and thus the gate of transistor N2 to which the drains of transistors N1 and N5 are connected) lower than the threshold voltage of transistor N2, assuming that the threshold voltage of transistor N2 equals the voltage at the drain of transistors N1 and N5 when the current flowing through transistor N1 is equal in magnitude to comparison current $I_B$.

As input current $I_{IN}$ increases, more current is conducted through resistor R2 and transistor N1 until that current exceeds comparison current $I_B$, at which point the drain of transistor N5 has risen to a level that exceeds the threshold voltage of transistor N2. This turns on transistor N2 to conduct current. Once transistor N2 is turned on, current is conducted through resistor R3, establishing a voltage drop from the source of transistor P5 to its gate. A portion of input current $I_{IN}$ is supplied by Stage 3 equal to the difference between the total input current $I_{IN}$ and the aggregate amount of current supplied by Stages 1 and 2. In a preferred embodiment, the current level flowing through transistor P3 when the current flowing through resistor R2 exceeds comparison current $I_B$ is designed to be equal to the maximum range magnitude for which Stage 2 and current mirror 74 is designed. Alternatively, the current level flowing through transistor P3 when the current flowing through resistor R2 exceeds comparison current $I_B$ may be designed to be greater or less than the maximum range magnitude for which Stage 2 and current mirror 74 is designed.

Current conducted by transistor P5 is mirrored by transistor P6. All output currents mirrored by Stages 1–3 are added together at output node 82,86 to produce total output current $I_{OUT}$ corresponding to total input current $I_{IN}$.

To adjust the respective current levels flowing through transistors P1,P3 when respective Stages 2 and 3 are turned on or off, the respective resistances of resistors R1 and R2 may be adjusted. Alternatively, the resistances of resistors R1 and R2 may be selected to be equal and the width to length ratio (W/L) of the transistors in each current mirror 72,74 may be adjusted instead.

To use current mirror circuit 70 in the tracking and sequencing application above, high gain op amp 26 and transistor N1 from FIG. 3 may be coupled to current mirror circuit 70 such that high gain op amp 26 and transistor N1 from FIG. 3 are interposed between the drain of transistor P1 and input node 80. More specifically, the drain of transistor N1 from FIG. 3 may be connected to the drain of transistor P1 and the source of transistor N1 from FIG. 3 may be connected to node 80. The output of the op amp is connected to the gate of transistor N1 from FIG. 3 and the inverting input of the op amp is connected to node 80 via a feedback network similar to that illustrated hereinabove.

In an alternative embodiment of current mirror circuit 70, transistor N6 may be eliminated and the source of transistor N2 may be tied directly to common ground. Moreover, any of the individual current mirrors discussed herein, e.g., current mirrors 72, 74 or 76 or the current mirrors formed by transistors N3–N6, may be substituted with current mirrors having cascode, Wilson or modified Wilson configurations.

Figure 8:
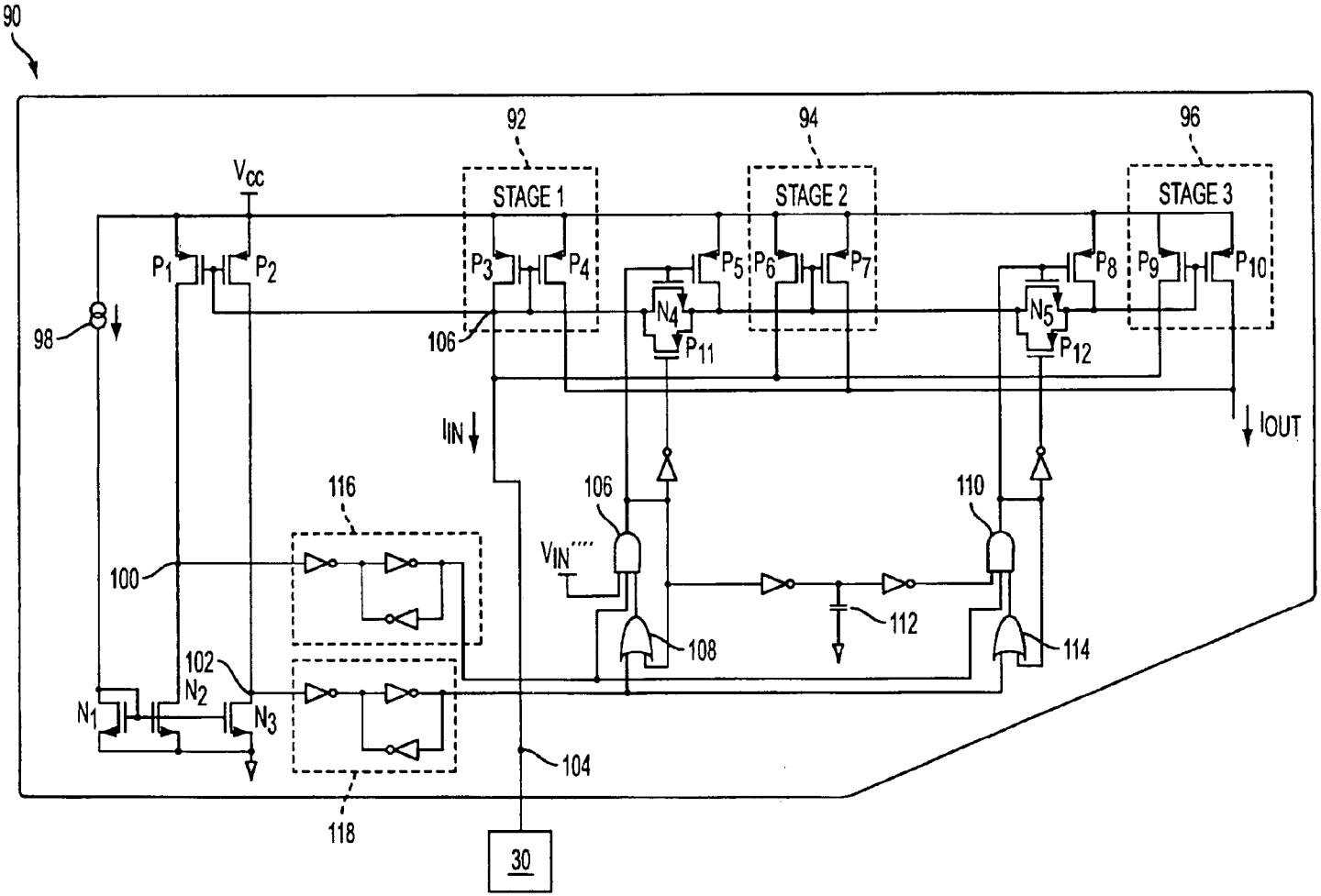
FIG. 8 is a schematic of a fourth embodiment of the current mirror circuit of the present invention.

Referring now to FIG. 8, a fourth embodiment of the current mirror circuit of the present invention is described, in which an alternative initiation circuit is employed automatically to (1) detect when a current mirror designed for small currents has reached capacity and (2) activate a second current mirror designed for larger currents responsive to that detection. Current mirror circuit 90 comprises three stages of current mirroring, each successive stage designed to mirror successively greater currents.

Stage 1 comprises first current mirror 92 having PMOS transistors P3 and P4 connected together so that their sources are tied to common supply voltage $V_{CC}$ and their gates are tied together. Transistors P3 and P4 are designed to have the same nominal threshold voltage and the same width to length (W/L) ratio. Stage 2 includes second current mirror 94 designed to mirror currents of magnitudes greater than current mirror 92 of Stage 1. Current mirror 94 also comprises two PMOS transistors P6 and P7 disposed with their sources connected to common supply voltage $V_{CC}$ and their gates tied together. Transistors P6 and P7 are designed to have the same nominal threshold voltage and the same width to length ratio. Stage 3 incorporates third current mirror 96 designed to mirror currents having magnitudes greater than the current magnitudes for which Stage 1 and Stage 2 are designed. Current mirror 96 of Stage 3 incorporates two PMOS transistors P9 and P10 disposed with their sources connected to common supply voltage $V_{CC}$ and their gates tied together. Transistors P9 and P10 are designed to have the same nominal threshold voltage and the same width to length ratio (W/L).

Current mirror circuit 90 measures the current density or level in Stage 1 and maintains the current level Stage 1 mirrors in a predefined range, e.g., 1–10 $\mu$A, for which it is designed by activating or deactivating additional mirror stages. Current mirror circuit 70 comprises comparator circuits to generate signals to indicate when the current mirrored by Stage 1 is outside its predefined range. More specifically, transistors P1 and P2 mirror current flowing through transistor P3 since the gates of all the transistors are tied together and the sources of all the transistors are tied to supply voltage $V_{CC}$. If the width to length (W/L) ratios of transistors P1–P3 are equal, transistors P1 and P2 mirror the current flowing through transistor P3 in a 1:1 ratio. Current source 98 provides current, e.g., 10 $\mu$A, to the drain of transistor N1, which is diode connected. Transistor N2, having a nominal threshold voltage equivalent to that of transistor N1, mirrors the current flowing through transistor N1 so that the ratio of currents flowing through transistors N1 to N2 is, e.g., 100:9 if the predefined current range for which Stage 1 is designed is 1–10 $\mu$A. If current source 98 provides, e.g., 10 $\mu$A, transistor N2 attempts to sink 0.9 $\mu$A. As discussed with respect to FIG. 7, when current flowing through transistor P1 is less than the magnitude of current that transistor N2 is attempting to sink, the signal at node 100 interposed between the drains of transistors P1 and N2 is LOW. When current flowing through transistors P1 is greater than or equal to the magnitude of current that transistor N2 is attempting to sink, the signal at node 100 is HIGH.

Likewise, transistor N3 also forms a current mirror with transistor N1. Transistor N3, having a nominal threshold voltage equivalent to that of transistor N1, mirrors the current flowing through transistor N1 so that the ratio of currents flowing through transistors N1 to N3 is, e.g., 1:1 if the predefined current range for which Stage 1 is designed is 1–10 $\mu$A. If current source 98 provides, e.g., 10 $\mu$A, transistor N3 attempts to sink 10 $\mu$A. When current flowing through transistor P2 is less than the magnitude of current that transistor N3 is attempting to sink, the signal at node 102 interposed between the drains of transistors P2 and N3 is LOW. When current flowing through transistors P2 is greater than or equal to the magnitude of current that transistor N3 is attempting to sink, the signal at node 102 is HIGH.

In operation, input circuit 30 that is coupled to input node 104 establishes a voltage at input node 104 that is less than supply voltage $V_{CC}$ when input current $I_{IN}$ is greater than zero. This sets up a positive $V_{SG}$ voltage across transistor P3 which has its gate connected to node 106 and its source connected to supply voltage $V_{CC}$. Thereafter, transistor P3 turns on and conducts current therethrough. Current flowing through transistor P3 is mirrored by transistors P1, P2 and P4. Transistor P4 generates an output current that is proportional to the current flowing through transistor P3 depending on width to length W/L ratios of transistors P3 and P4. Transistors P1 and P2 also mirror the current flowing through transistor P3 in a one to one correspondence assuming that the width to length ratios of transistors P1–P3 are equal.

As input current $I_{IN}$ increases from 0A to, e.g., 0.9 $\mu$A, the signal at node 100 goes HIGH when the current flowing through transistor P3 is equal to or greater than, e.g., 0.9 $\mu$A, and is fed to AND gates 106 and 110. When the current flowing through transistor P2 is equal to or greater than, e.g., 10 $\mu$A, the signal at node 102 also goes HIGH. At this point, AND gate 106, which constantly is enabled by supply voltage $V_{CC}$, outputs a signal HIGH, which is fed to the gates of transistors P5 and N4. The HIGH output of AND gate 106 also is fed to the gate of transistor P11 after being inverted.

The HIGH output of AND gate 106 biases on transistors N4 and P11 and biases off transistor P5, turning on Stage 2 for current conduction by connecting transistor P6 of Stage 2 in parallel with transistor P3 of Stage 1. Input current $I_{IN}$ is redistributed so that the current through transistor P3 drops to, e.g., 1 $\mu$A, and through transistor P6 increases to, e.g., 9 $\mu$A, assuming that the width to length ratio (W/L) of transistors P6 and P7 is configured to be 9×that of transistor P3.

When the current through transistor P3 drops to, e.g., 1 $\mu$A, the signal at node 102 goes LOW. The signal HIGH output of AND gate 106 is maintained, however, due to the latching effect of OR gate 108, which accepts the signal HIGH output of AND gate 106 and the signal LOW from node 102.

The signal HIGH output of AND gate 106 is passed to AND gate 110 after a delay effected by capacitor 112. Once the delayed HIGH signal is accepted by AND gate 110, Stage 3 is enabled and can be turned on once the current through transistor P3 equals or exceeds, e.g., 10 $\mu$A. More specifically, as input current $I_{IN}$ increases further to, e.g., 100 $\mu$A, 10 $\mu$A flows through transistor P3 and is mirrored by Stage 1, while 90 $\mu$A flows through transistor P6 and is mirrored by Stage 2. Since mode 102 is configured to go HIGH when the current flowing through transistor P3 reaches, e.g., 10 $\mu$A, AND gate 110 outputs a signal HIGH that connects transistor P9 in parallel with transistors P3 and P6. At this point, input current $I_{IN}$ is redistributed so that the current through transistor P3 decreases to, e.g., 1 $\mu$A, transistor P6 decreases to, e.g., 9 $\mu$A, and transistor P9 increases to, e.g., 90 $\mu$A, assuming that the width to length ratio (W/L) of transistors P6 and P7 is configured to be 90 x that of transistor P3 and the W/L ratio of transistors P9 and P10 is configured to be 90× that of transistor P3. In a preferred embodiment, Stage 1 is designed to conduct current magnitudes in the range, e.g., 1–10 $\mu$A, Stage 2 is designed to conduct current magnitudes in the range, e.g., 9–90 $\mu$A, and Stage 3 is designed to conduct current magnitudes in the range, e.g., 90–900 $\mu$A. Alternatively, each mirror stage may be designed to conduct current in different ranges of magnitudes.

When the current through transistor P3 drops to, e.g., 1 $\mu$A, the signal at node 102 goes LOW. The signal HIGH output of AND gate 110 is maintained, however, due to the latching effect of OR gate 114, which accepts the signal HIGH output of AND gate 110 and the signal LOW from node 102.

As input current $I_{IN}$ decreases, the signal at node 100 goes LOW and turns off Stages 2 and 3 when input current $I_{IN}$ decreases below, e.g., 90 $\mu$A, and consequently the current through transistor P3 decreases below, e.g., 0.9 $\mu$A. Immediately thereafter, the signals at nodes 100 and 102 go HIGH to turn Stage 2 back on. When input current $I_{IN}$ decreases below, e.g., 9 $\mu$A, the signal at node 100 goes LOW and turns off Stage 2.

To sharpen the transition between states, current mirror circuit 90 may interpose first Schmitt trigger 116 between node 100 and AND gates 106,110, and second Schmitt trigger 118 between node 102 and OR gates 108,114. Although FIG. 8 illustrates Schmitt triggers comprising fed-back inverters, Schmitt triggers 116 and 118 may comprise other configurations.

To use current mirror circuit 90 in the tracking and sequencing application above, high gain op amp 26 and transistor N1 may be coupled to current mirror circuit 90 such that high gain op amp 26 and transistor N1 from FIG. 3 are interposed between the drain of transistor P3 and input node 104. More specifically, the drain of transistor N1 from FIG. 3 may be connected to the drain of transistor P3 and the source of transistor N1 from FIG. 3 may be connected to node 104. The output of the op amp is connected to the gate of transistor N1 from FIG. 3 and the inverting input of the op amp is connected to node 104 via a feedback network similar to that illustrated hereinabove.

One of ordinary skill in the art will recognize that any of the individual current mirrors described herein, e.g., current mirrors 92, 94 or 96 or the current mirrors formed by transistors P1, P2 or N1–N3, may be substituted with current mirrors having cascode, Wilson or modified Wilson configurations.

While current mirror circuit 90 illustrates use of a series of latches, the mirror stages also may be digitally controlled by alternative methods, such as driving an increment/decrement counter.

Although illustrative embodiments of the present invention are described above, one skilled in the art will recognize that various changes and modifications may be made with minor design modifications without departing from the invention. For example, while the current mirror circuit embodiments described herein are configured to source current, one of ordinary skill in the art will recognize that the current mirror circuit of the present invention also may be configured to sink current. Furthermore, one or more MOSFETs may be replaced with other types of transistors, such as bipolar junction transistors or insulated gate bipolar transistors. In addition, all PMOSs may be replaced with NMOSs and vice versa.

While the above-described embodiments are configured such that successive stages of current mirrors are designed to mirror increasing magnitudes of current, the successive stages of current mirrors also may be designed for the same or decreasing magnitudes of current (or combinations thereof). One of ordinary skill in the art will recognize that additional current mirrors may be added to any of the above-described embodiments. All values, e.g., voltages, currents, mirror ratios, and width to length ratios (W/L), provided in the above description are for illustrative purposes only. Different values may be used without departing from the scope of the invention. All reference voltages may comprise the same threshold levels or one or more different levels, and may be constant or variable in nature.

It is intended in the appended claims to cover all such changes and modifications that fall within the true spirit and scope of the invention.

What is claimed is:

1. A circuit that sinks or sources output current responsive to input current, wherein the output current is proportional to the input current, the circuit comprising:

a first current mirror having a first current range, the first current range having a maximum range magnitude;

a second current mirror having a second current range; and an initiation circuit coupled to the first and second current mirrors, the initiation circuit configured automatically to (1) detect when the magnitude of the input current equals or exceeds a maximum current level and (2) activate the second current mirror responsive thereto.

2. The circuit of claim 1, wherein the maximum current level does not equal the maximum range magnitude.

3. The circuit of claim 1, wherein the first and second current mirrors are coupled so that the aggregation of individual output currents provided by the first and second current mirrors equal the output current.

4. The circuit of claim 1, wherein the first and second current mirrors comprise cascode current mirrors.

5. The circuit of claim 1, wherein the initiation circuit comprises a first transistor coupled to the second current mirror, the first transistor having a first threshold voltage, and an operational amplifier that outputs an output signal, the first transistor configured to activate the second current mirror responsive to the output signal exceeding the first threshold voltage.

6. The circuit of claim 5, wherein the initiation circuit comprises a second transistor coupled to the first current mirror and to the operational amplifier, the second transistor having a second threshold voltage that is less than the first threshold voltage, the second transistor configured to activate the first current mirror responsive to the output signal exceeding the second threshold voltage.

7. The circuit of claim 1, further comprising an input terminal having an input terminal voltage and an operational amplifier that servos the input terminal voltage at a reference voltage.

8. The circuit of claim 7, further comprising a transistor coupled to the input terminal, wherein the transistor is configured to deactivate the first current mirror when the input terminal voltage equals or exceeds the reference voltage.

9. The circuit of claim 8, wherein the transistor is configured to deactivate the second current mirror when the input terminal voltage equals or exceeds the reference voltage.

10. The circuit of claim 1, further comprising a compensation network.

11. The circuit of claim 1, wherein the magnitude of the maximum current level is less than that of the maximum range magnitude.

12. The circuit of claim 1, wherein the initiation circuit comprises a third current mirror configured to source or sink a comparison current when the magnitude of the input current equals or exceeds the maximum current level.

13. The circuit of claim 12, wherein the magnitude of the comparison current equals the magnitude of the maximum current level.

14. The circuit of claim 1, wherein the magnitude of the maximum current level equals the magnitude of the maximum range magnitude.

15. The circuit of claim 1, wherein the first and second current ranges do not overlap.

16. The circuit of claim 1, wherein the first and second current ranges overlap at the maximum range magnitude.

17. A method for sourcing or sinking output current responsive to input current, wherein the output current is proportional to the input current, the method comprising:

providing a first current mirror having a first current range, the first current range having a maximum range magnitude, and a second current mirror having a second current range;

mirroring the input current with the first current mirror;

automatically detecting when the magnitude of the input current equals or exceeds a maximum current level;

automatically activating the second current mirror responsive to detection that the magnitude of the input current equals or exceeds the maximum current level; and mirroring at least a fraction of the input current with the second current mirror.

18. The method of claim 17, further comprising:

automatically detecting when the magnitude of the input current drops below the maximum current level; and automatically deactivating the second current mirror responsive to detection that the magnitude of the input current has dropped below the maximum current level.

19. The method of claim 17, wherein automatically detecting when the magnitude of the input current equals or exceeds a maximum current level comprises automatically detecting when the magnitude of the input current equals or exceeds the maximum range magnitude.

20. The method of claim 17, wherein automatically detecting when the magnitude of the input current equals or exceeds a maximum current level comprises automatically detecting when the magnitude of the input current equals or exceeds a value less than the maximum range magnitude.

21. The method of claim 17, wherein the first and second current mirrors incorporate cascode transistors, the method further comprising biasing the cascode transistors.

22. The method of claim 17, wherein providing further comprises providing an operational amplifier and a transistor coupled to the second current mirror, the transistor having a threshold voltage, and wherein automatically activating the second current mirror comprises:

outputting an output signal from the operational amplifier, the output signal responsive to the input current; and automatically activating the second current mirror after the output signal equals or exceeds the threshold voltage.

23. The method of claim 17, wherein providing further comprises providing an input terminal coupled to the first current mirror, the input terminal having an input terminal voltage, the method further comprising servoing the input terminal voltage at a reference voltage.

24. The method of claim 23, further comprising deactivating the first current mirror when the input terminal voltage equals or exceeds the reference voltage.

25. The method of claim 17, wherein automatically detecting when the magnitude of the input current equals or exceeds a maximum current level comprises:

generating a detection signal responsive to the input current; and compensating the detection signal.

26. The method of claim 17, wherein providing further comprises providing a third current mirror configured to source or sink a comparison current, and wherein automatically detecting when the magnitude of the input current equals or exceeds a maximum current level comprises sourcing or sinking a comparison current when the magnitude of the input current equals or exceeds the maximum current level.

* * * * *

UNITED STATES PATENT AND TRADEMARK OFFICE

CERTIFICATE OF CORRECTION

PATENT NO. : 6,897,717 B1
DATED : May 24, 2005
INVENTOR(S) : Eddleman et al.

It is certified that error appears in the above-identified patent and that said Letters Patent is hereby corrected as shown below:

Column 2,
Line 58, delete "is".

Column 3,
Line 12, change "FIG. 5" to -- FIGS. 5 --.

Column 7,
Line 11, change "$V_{BIA2}$" to -- $V_{BIAS2}$ --.

Column 8,
Line 64, change "VASTER" to -- $V_{MASTER}$ --.

Column 9,
Line 7, change "VASTER" to -- $V_{MASTER}$ --.

Column 11,
Lines 63 and 65, change "FIG. 3" to -- FIGS. 3 --.

Column 13,
Line 49, change "9xthat" to -- 9x that --.

Column 14,
Lines 41, 44, 45 and 47, change "FIG." to -- FIGS. --.

Signed and Sealed this

Eleventh Day of April, 2006

JON W. DUDAS
*Director of the United States Patent and Trademark Office*